US009983519B2

(12) United States Patent
Egi

(10) Patent No.: US 9,983,519 B2
(45) Date of Patent: May 29, 2018

(54) IMAGE FORMING APPARATUS MEASURING RESISTANCE VALUE OF PRIMARY TRANSFERRING PART WITH CURRENT VALUE DETECTED WHEN PRIMARY TRANSFERRING PART IS PRESENT BETWEEN SHEETS

(71) Applicant: KYOCERA Document Solutions Inc., Osaka (JP)

(72) Inventor: Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/610,651

(22) Filed: Jun. 1, 2017

(65) Prior Publication Data

US 2017/0371274 A1 Dec. 28, 2017

(30) Foreign Application Priority Data

Jun. 24, 2016 (JP) ..... 2016-125474

(51) Int. Cl.
*G03G 15/16* (2006.01)

(52) U.S. Cl.
CPC ..... *G03G 15/1665* (2013.01); *G03G 15/1605* (2013.01)

(58) Field of Classification Search
CPC ..... G03G 15/1605; G03G 15/1625; G03G 15/1665
See application file for complete search history.

(56) References Cited

FOREIGN PATENT DOCUMENTS

JP 2004-062086 A 2/2004

*Primary Examiner* — Erika J Villaluna
(74) *Attorney, Agent, or Firm* — Studebaker & Brackett PC

(57) ABSTRACT

An image forming apparatus includes a transferring belt, photosensitive drums along the belt, primary transferring parts transferring images from the drums to the belt, voltage applying parts applying transfer voltages to the respective transferring parts when each transferring part carries out transfer, a current detecting part and a resistance value measuring part. When the measuring part carries out resistance value measurement, if one transferring part is a measurement subject of the measuring part, the applying part applies zero or weak voltage to the one transferring part and applies the transfer voltage to other transferring parts at measurement timing when the one transferring part is between sheets. At the measurement timing, the detecting part detects a first total current value of currents flowing thorough the transferring parts and the measuring part measures the subject resistance value of the one transferring part based on the first total current value.

10 Claims, 4 Drawing Sheets

FIG. 3

| PRIMARY TRANSFERRING PART | YELLOW | CYAN | MAGENTA | BLACK |
|---|---|---|---|---|
| PRINTING | +1000 | +1000 | +1000 | +1000 |
| MEASURING OF YELLOW | +50 | +1000 | +1000 | +1000 |
| MEASURING OF CYAN | +1000 | +50 | +1000 | +1000 |
| MEASURING OF MAGENTA | +1000 | +1000 | +50 | +1000 |
| MEASURING OF BLACK | +1000 | +1000 | +1000 | +50 |

(V)

IMAGE FORMING APPARATUS MEASURING RESISTANCE VALUE OF PRIMARY TRANSFERRING PART WITH CURRENT VALUE DETECTED WHEN PRIMARY TRANSFERRING PART IS PRESENT BETWEEN SHEETS

INCORPORATION BY REFERENCE

This application is based on and claims the benefit of priority from Japanese Patent application No. 2016-125474 filed on Jun. 24, 2016, the entire contents of which are incorporated herein by reference.

BACKGROUND

The present disclosure relates to an image forming apparatus including a plurality of photosensitive drums along a transferring belt.

An image forming apparatus of an electrographic manner includes a plurality of photosensitive drums along a transferring belt and includes a plurality of primary transferring parts with respect to the respective plurality of photosensitive drums. A surface of each photosensitive drum is electrically charged and exposed according to image data to thereby form an electrostatic latent image, and further, a toner of each color is deposited to the electrostatic latent image and developed to thereby form a toner image of each color. The toner image of each color formed at each photosensitive drum is primarily transferred to a transferring belt by each primary transferring part to which a voltage of opposite polarity to the toner is applied, and accordingly, a toner image of full color is formed.

In order to supply a suitable transferring current to each primary transferring part, it is necessary to apply a transfer voltage according to a resistance of a transferring member, such as a roller or a belt, constituting each primary transferring part. However, the transferring member, such as the roller or belt, constituting each primary transferring part may be degraded due to temperature change or aged deterioration, and a resistance value may be varied. Therefore, it is necessary to correct the transfer voltage according to variation of the resistance value of each primary transferring part.

For example, an image forming apparatus includes: an image carrier in which a developer image is formed on its surface; an intermediate transferring body to which the developer image is transferred; and a secondary transferring means transferring the developer image from the intermediate transferring body to a recording medium by applying a secondary transferring bias to a secondary transferring part. A volume resistance rate of the intermediate transferring body has temperature dependency. The image forming apparatus also has a temperature sensing means sensing temperature of the intermediate transferring body. In addition, according to a result of temperature sensing by the temperature sensing means, impedance (resistance value) of the secondary transferring part is sensed, and then, an applied voltage of the secondary transferring bias is controlled.

However, because detection of the resistance value of the transferring member takes time, in a construction including a plurality of primary transferring parts for the respective toner colors as a color printer, further time is required to measure the resistance value of each primary transferring part. In addition, if a transfer voltage is corrected according to variation of the resistance value of each primary transferring part, a furthermore time is required. Thus, productivity of printing process utilizing the plurality of primary transferring parts may be impeded.

SUMMARY

In accordance with the present disclosure, an image forming apparatus includes an annular transferring belt rotating in a predetermined direction, a plurality of photosensitive drums, a plurality of primary transferring parts, a plurality of voltage applying parts, a current detecting part and a resistance value measuring part. The plurality of photosensitive drums are disposed along a rotation direction of the transferring belt. The plurality of primary transferring parts transfer images formed on the plurality of photosensitive drums to the transferring belt. The voltage applying parts apply voltages to the plurality of respective primary transferring parts. The current detecting part detects a total current value of currents flowing thorough the plurality of primary transferring parts. The resistance value measuring part measures a subject resistance value of each of the primary transferring parts. When transfer is carried out by each primary transferring part, the corresponding voltage applying part applies a transfer voltage to each primary transferring part. On the other hand, when resistance value measurement by the resistance value measuring part is carried out, in a case where one primary transferring part of the plurality of primary transferring parts is a measurement subject of the resistance value measuring part, the corresponding voltage applying part applies a zero voltage or a weak voltage with the same polarity as the transfer voltage to the one primary transferring part and applies the transfer voltage to other primary transferring parts at a measurement timing when the one primary transferring part is present between sheets. The current detecting part detects a first total current value at the measurement timing. The resistance value measuring part measures the subject resistance value of the one primary transferring part on the basis of the first total current value detected at the measurement timing.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 3 is a table showing a voltage applied to each primary transferring part in the color printer according to the embodiment of the present disclosure.

DETAILED DESCRIPTION

Figure 1:
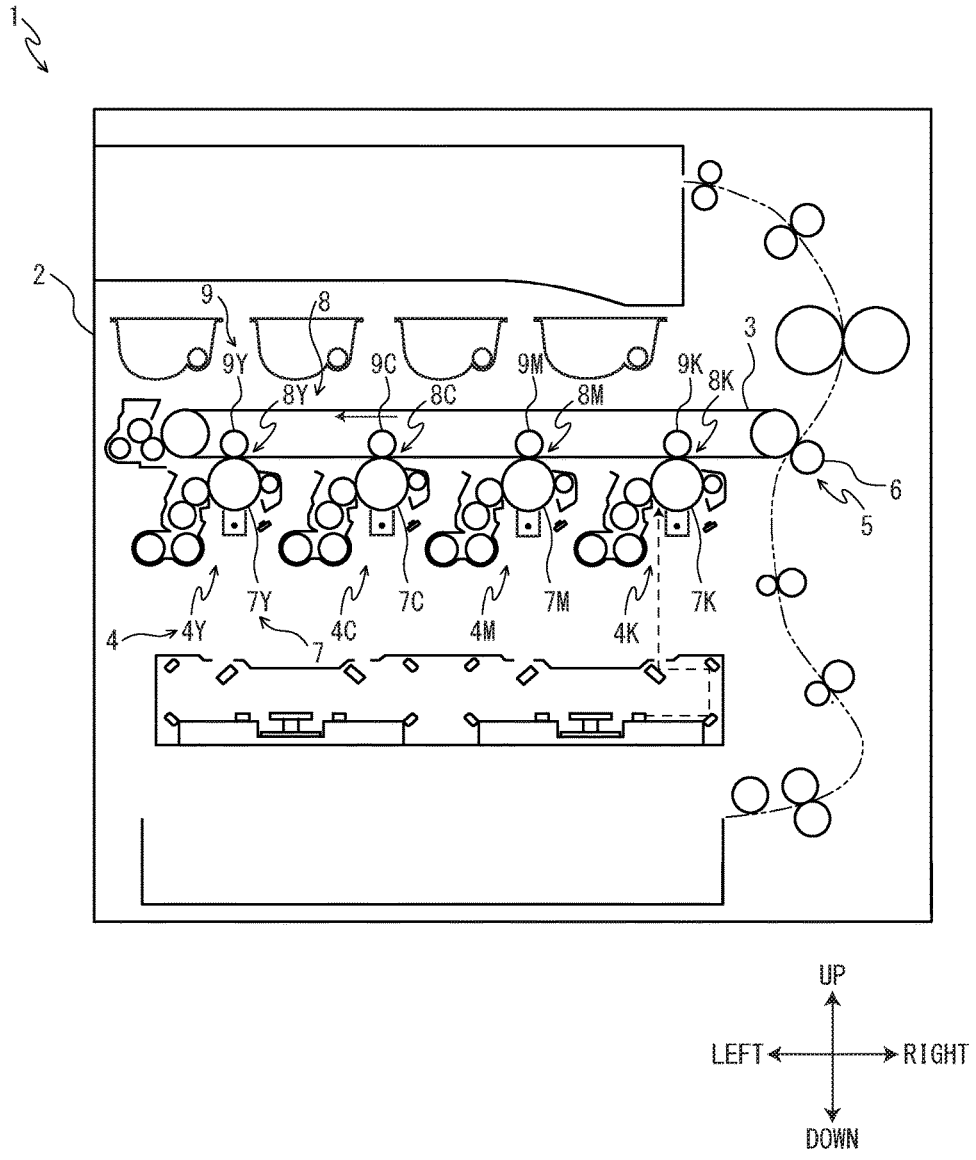
FIG. 1 is a sectional view showing a color printer according to an embodiment of the present disclosure.

First, an entire configuration of a color printer 1 (an image forming apparatus) according to an embodiment of the present disclosure will be described with reference to FIG. 1. Hereinafter, for the sake of convenience of description, it will be described so that the front side of the color printer 1 is positioned at a sheet front side in FIG. 1.

The color printer 1 includes a roughly box-formed printer body 2 and, at a center part of the printer body 2, an annular intermediate transferring belt 3 (a transferring belt) rotating in a predetermined direction is stretched among a plurality of rollers. At a lower side of the intermediate transferring belt 3, four image forming parts 4 (4Y, 4C, 4M and 4K) are provided for the respective toner colors (for example, four colors of yellow, cyan, magenta and black). The respective image forming parts 4 correspond to the respective colors of yellow (Y), cyan (C), magenta (M) and black (K) in a sequential order from an upstream side in a rotation direction of the intermediate transferring belt 3 (the left side in the embodiment). Hereinafter, except for a case where components respectively corresponding to the toner colors are described with specifying the respective toner color, the reference codes "Y", "C", "M" and "K" are omitted with respect to description of the respective components. At a right end of the intermediate transferring belt 3, a secondary transferring part 5 is provided and the secondary transferring part 5 is composed of a part at the right end side of the intermediate transferring belt 3; and a secondary transferring roller 6.

At the respective image forming parts 4, photosensitive drums 7 are rotatably provided, in other words, four photosensitive drums 7 (7Y, 7C, 7M and 7K) are disposed along the rotation direction of the intermediate transferring belt 3. At the periphery of the photosensitive drums 7, primary transferring parts 8 are disposed, in other words, four primary transferring parts 8 (8Y, 8C, 8M and 8K) are provided with respect to the respective four photosensitive drums 7 (7Y, 7C, 7M and 7K). Each primary transferring part 8 is composed of a part of the intermediate transferring belt 3 and each one of primary transferring rollers 9 and each primary transferring roller 9 is disposed to oppose to each photosensitive drum 7 across the intermediate transferring belt 3. In other words, the four primary transferring rollers 9 (9Y, 9C, 9M and 9K) of the four primary transferring parts 8 (8Y, 8C, 8M and 8K) are respectively disposed to face to the four photosensitive drums 7 (7Y, 7C, 7M and 7K).

In an image forming process of the color printer 1, an image of each color is formed at each image forming part 4. At this time, in each image forming part 4, first, each photosensitive drum 7 is electrically charged by a charger (not shown). Afterwards, on the basis of image data inputted from an external computer (not shown) or the like, the photosensitive drum 7 is exposed by an exposure device (not shown), and thereby, each one of electrostatic latent images is formed on each photosensitive drum 7. Each electrostatic latent image on each photosensitive drum 7 is developed to each one of toner images of the respective colors by each one of development devices (not shown). Each toner image on each photosensitive drum 7 is primarily transferred to a surface of the intermediate transferring belt 3 by each primary transferring part 8. The operation described above is sequentially repeated by the image forming parts 4, and thereby, a toner image of full color (hereinafter, referred to as a color toner image) is formed on the intermediate transferring belt 3.

In the image forming process of the color printer 1, the color toner image is then supplied to the secondary transferring part 5 by rotation of the intermediate transferring belt 3. At the secondary transferring part 5, a sheet is supplied from a sheet feeding cartridge (not shown) in accordance with a timing with the supply of the color toner image and the color toner image on the intermediate transferring belt 3 is secondarily transferred to the sheet. Further, in the color printer 1, the color toner image on the sheet is fixed by a fixing device (not shown) and the sheet with the fixed color toner image is ejected to a sheet ejecting tray (not shown).

Figure 2:
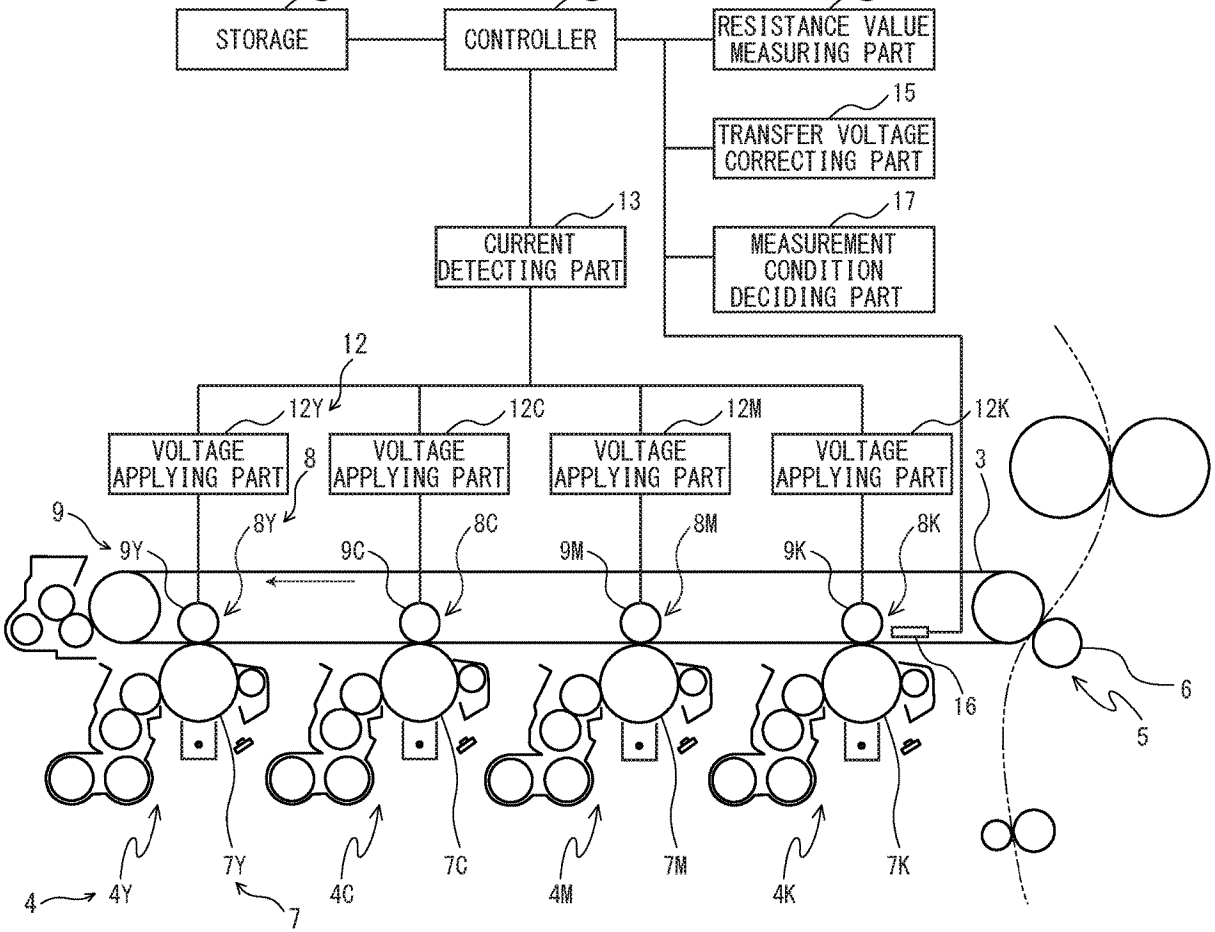
FIG. 2 is a schematic view showing an electrical configuration in the color printer according to the embodiment of the present disclosure.

Next, an electrical configuration of the color printer 1 will be described with reference to FIG. 2. The color printer 1 includes a controller 10, a storage 11, four voltage applying parts 12 (12Y, 12C, 12M and 12K), a current detecting part 13, a resistance value measuring part 14, a transfer voltage correcting part 15, a temperature sensing part 16 and a measurement condition deciding part 17.

In the color printer 1, the respective primary transferring parts 8 act as measurement subjects of a resistance value by the resistance value measuring part 14 at difference timings and each measurement subject of the resistance value measuring part 14 also acts as a correction subject of a transfer voltage by the transfer voltage correcting part 15. Incidentally, the primary transferring part 8 as the measurement subject of the resistance value measuring part 14 may be switched every time image is sequentially transferred to the intermediate transferring belt 3 in accordance with a sequential order of disposition of the four primary transferring parts 8, or alternatively, may be specified or selected from the four primary transferring parts 8 on the basis of a predetermined condition. Measurement timing of the resistance value measuring part 14 of the primary transferring part 8 as the measurement subject is set to a timing when the primary transferring part 8 as the measurement subject is present between sheets, in a series of image forming operations using the four primary transferring parts 8 (the four image forming parts 4), e.g. a timing immediately after transfer of the primary transferring part 8. Correction timing of the transfer voltage correcting part 15 of the primary transferring part 8 as the measurement subject is the same as the measurement timing of the resistance value measuring part 14.

The controller 10 consists of a CPU or the like, is connected to the storage 11, the four voltage applying parts 12, the current detecting part 13, the resistance value measuring part 14, the transfer voltage correcting part 15, the temperature sensing part 16, the measurement condition deciding part 17 and other components included in the color printer 1 and is configured to be able to control each of components.

The storage 11 consists of a ROM, a RAM and others to store programs and data required to actualize the image forming process or other various functions of the color printer 1. Incidentally, although in FIG. 2, the resistance value measuring part 14, the transfer voltage correcting part 15 and the measurement condition deciding part 17 are illustrated to be independent of the storage 11, these parts may be composed of the programs stored in the storage 11 and executed by the controller 10.

The four voltage applying parts 12 are provided to respectively correspond to the four primary transferring parts 8. Each voltage applying part 12 is connected to each primary transferring roller 9 of each primary transferring part 8 to apply a voltage to each primary transferring roller 9. For example, in a case where each primary transferring part 8 carries out primary transferring operation, each voltage applying part 12 applies a transfer voltage to each primary transferring roller 9 so that a predetermined target transfer current flows through each primary transferring roller 9. The transfer voltage to be applied by each voltage applying part 12 is a voltage value suitable for each primary transferring roller 9 and may be any one of different voltage values from each other among the four voltage applying parts 12.

Each of the four voltage applying part 12 applies, in a case of acting for resistance value measurement by the resistance value measuring part 14, applies a zero voltage or a weak voltage with the same polarity as the transfer voltage to the primary transferring part 8 as the measurement subject at the measurement timing when the primary transferring part 8 as the measurement subject is present between sheets, and simultaneously, applies the transfer voltage to other primary transferring parts 8.

The current detecting part 13 is connected to the four voltage applying parts 12, is a detecting circuit of a current value common to the four primary transferring rollers 9 (the four primary transferring parts 8) and detects a total current value of the currents flowing through the four primary transferring rollers 9. Incidentally, although the embodiment is described as to an example of providing one current detecting part 13 common to the four primary transferring rollers 9, the configuration of the current detecting part 13 is not limited by this example. As another example, two current detecting parts 13 may be provided, the primary transferring rollers 9 are connected two by two to each current detecting part 13, and each current detecting part 13 detects the total current value of the currents flowing through the two primary transferring rollers 9.

The current detecting part 13 detects, for example, in a case of acting for the resistance value measurement by the resistance value measuring part 14, a total current value of the currents flowing through the four primary transferring rollers 9 as a first total current value at the measurement timing with respect to the primary transferring part 8 as the measurement subject (the timing when the zero voltage or the weak voltage is applied to the primary transferring roller 9 as the measurement subject while the transfer voltage is applied to other primary transferring rollers 9). In addition, the current detecting part 13 detects a total current value of the currents flowing through the four primary transferring rollers 9 as a second total current when the four voltage applying parts 12 have applied the respective transfer voltages to the four primary transferring rollers 9 (the four primary transferring parts 8) and the detected value is stored in the storage 11 or the like.

The resistance value measuring part 14 measures the resistance value of each primary transferring roller 9 (each primary transferring part 8) on the basis of the voltage value applied by each voltage applying part 12 or the total current value detected by the current detecting part 13 or other value. For example, the resistance value measuring part 14 measures a subject resistance value of the primary transferring roller 9 (the primary transferring part 8) as the measurement subject on the basis of the first total current value detected by the current detecting part 13 at the measurement timing with respect to the primary transferring part 8 as the measurement subject.

Specifically, the resistance value measuring part 14 measures a subject current value (a transfer current) flowing through the primary transferring roller 9 as the measurement subject on the basis of a current difference between the first total current value in a case where the zero voltage or the weak current is applied to the primary transferring roller 9 as the measurement subject and the second total current value in a case where the transfer voltage is applied to all of the primary transferring rollers 9. Subsequently, the resistance value measuring part 14 measures the subject resistance value of the primary transferring roller 9 as the measurement subject on the basis of the transfer voltage and the subject current value, for example, by dividing the transfer voltage by the subject current value.

The transfer voltage correcting part 15 corrects the transfer voltage applied to each primary transferring roller 9 (each primary transferring part 8) by each voltage applying part 12 in accordance with a predetermined correction condition to make a voltage value so that the predetermined target transfer current flows. For example, the transfer voltage correcting part 15 sets, as a correction condition correcting the transfer voltage, a case where a difference between the subject resistance value measured with respect to the primary transferring roller 9 (the primary transferring part 8) as the measurement subject by the resistance value measuring part 14 and a predetermined target resistance value is equal to or more than a predetermined resistance value difference. For example, because the resistance value of the primary transferring roller 9 may have a variation of the order of $10^{6.8}$ to $10^{7.8}$ ohms, a predetermined resistance value difference may be set to the order of $10^{0.1}$ to $10^{0.2}$ ohms. Subsequently, the transfer voltage correcting part 15 calculates a transfer voltage after correction on the basis of the predetermined target transfer current and the subject resistance value, for example, by multiplying the predetermined target transferring current by the subject resistance value. The predetermined target resistance value is predetermined, for example, at a resistance value of the primary transferring roller 9 (the primary transferring part 8) at the time of factory shipment, and then, when transfer voltage correction is carried out by the transfer voltage correcting part 15, the target resistance value is updated and set to the subject resistance value measured by the resistance value measuring part 14 at the time of that correction.

Incidentally, the transfer voltage correcting part 15 may store correction execution triggers of the transfer voltage indicating the correction conditions for the respective four primary transferring rollers 9 in the storage 11 or the like. The transfer voltage correcting part 15 sets the correction execution trigger to OFF in a case where a difference between the subject resistance value and the predetermined target resistance value is less than a predetermined resistance value difference, or alternatively, sets the correction execution trigger to ON in a case where the difference between the subject resistance value and the predetermined target resistance value is equal to or more than the predetermined value difference. The transfer voltage correcting part 15 carries out transfer voltage correction with respect to the primary transferring roller 9 corresponding to the correction execution trigger of ON after the correction conditions with respect to the four primary transferring rollers 9 are decided. Alternatively, the transfer voltage correcting part 15 may carry out transfer voltage correction every time the correction condition of each primary transferring roller 9 is established.

The temperature sensing part 16 senses temperature in the vicinity of the immediate transferring belt 3 and the four primary transferring parts 8. Incidentally, although only one temperature sensing part 16 is provided, individual temperature sensing parts 16 may be provided with respect to the intermediate transferring belt 3 and the respective four primary transferring parts 8.

The measurement condition deciding part 17 decides in accordance with a predetermined measurement condition that resistance value measurement by the resistance value measuring part 14 should be carried out. For example, the measurement condition deciding part 17 may set, as the predetermined measurement condition, a case where a difference between the present temperature sensed by the temperature sensing part 16 and the preceding temperature sensed by the temperature sensing part 16 at the time of the preceding correction by the transfer voltage correcting part 15 is equal to or more than a predetermined temperature difference (for example, the order of 10 degrees centigrade). Further, the measurement condition deciding part 17 may set, as the predetermined measurement condition, a case where a driving time of the intermediate transferring belt 3 and the four primary transferring parts 8 has elapsed by a predetermined time (for example, driving time of the order of 12 hours) or more from the time of the preceding correction by the transfer voltage correcting part 15. Incidentally, in a case where the driving time has elapsed by the predetermined time, a count of the driving time is reset and the subsequent elapse of the predetermined time is set as the measurement condition.

Figure 4:
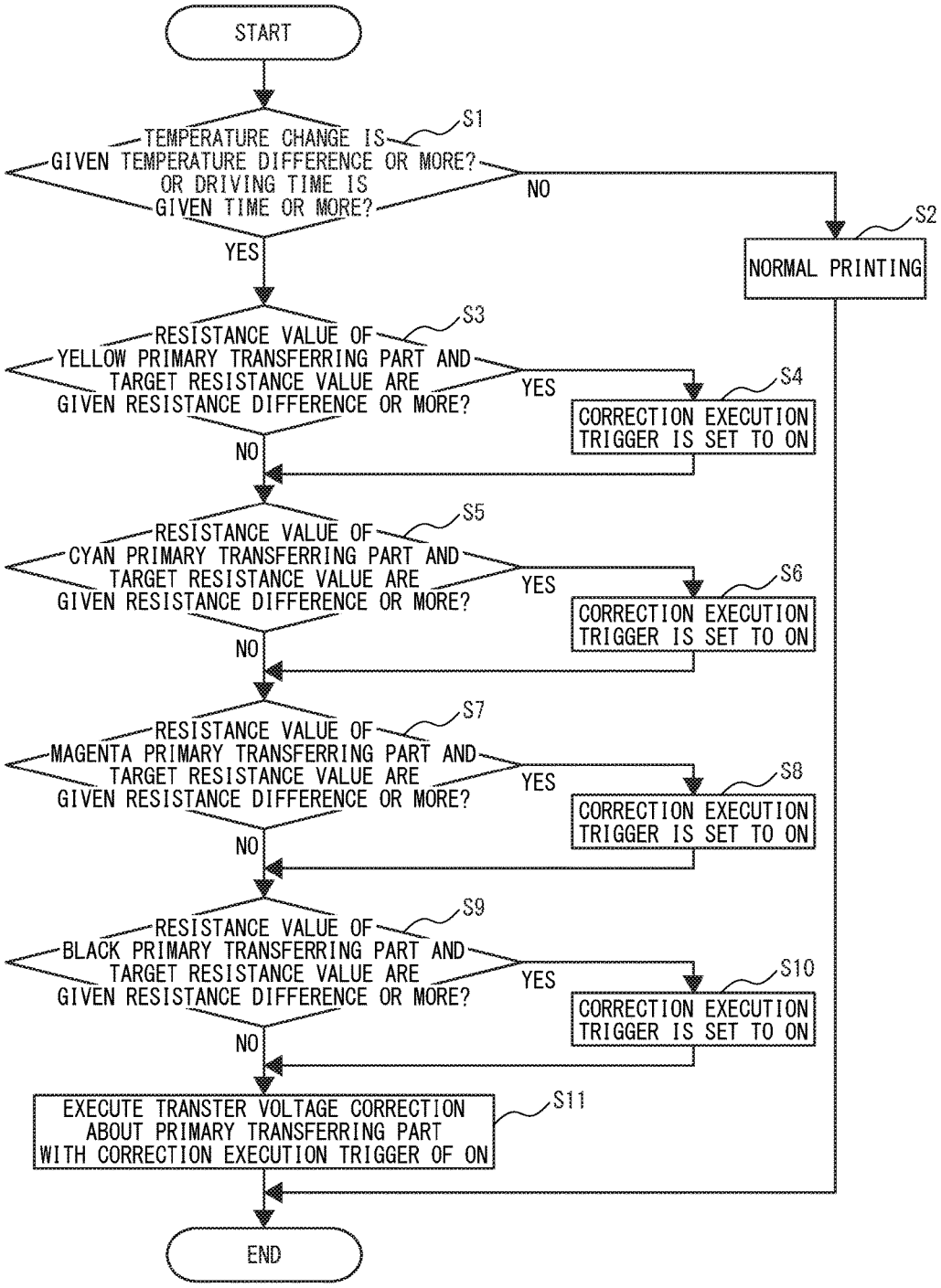
FIG. 4 is a flowchart showing operations of resistance value measurement and transfer voltage correction of each primary transferring part in the color printer according to the embodiment of the present disclosure.

Next, image forming operation (printing operation) of the four image forming parts 4 of the embodiment and operations of resistance value measurement and transfer voltage correction of the primary transferring part 8 will be described with reference to a table of FIG. 3 and a flowchart of FIG. 4.

As shown in FIG. 3, in a case where all of the four image forming parts 4 are in printing, each voltage applying part 12 applies a transfer voltage of +1,000 V to each primary transferring roller 9 (each primary transferring part 8). At this time, the second total current values of the four primary transferring rollers 9 are detected by the current detecting part 13 and stored in the storage 11.

First, by the measurement condition deciding part 17, a temperature change and the driving time of the intermediate transferring belt 3 or the four primary transferring part 8 is decided (step S1). Here, in a case where the temperature change is less than the predetermined temperature difference or in a case where the driving time is less than a predetermined driving time, the measurement condition deciding part 17 decides that resistance value measurement by the resistance value measuring part 14 is not needed (step S1: NO) and operation is shifted to normal printing (step S2). On the other hand, in a case where the temperature change is equal to or more than the predetermined temperature difference or in a case where the driving time is equal to or more than the predetermined driving time, the measurement condition deciding part 17 decides that resistance value measurement by the resistance value measuring part 14 should be carried out (step S1: YES).

In the four image forming parts 4, first, at a yellow image forming part 4Y, image forming operation is carried out. At this time, the transfer voltage (+1,000 V) is applied from the yellow voltage applying part 12Y to the yellow primary transferring roller 9Y (the yellow primary transferring part 8Y), and then, primary transferring operation of a yellow toner image is carried out with respect to a predetermined printing position on the intermediate transferring belt 3. The second total current value described above may be detected here.

When the yellow primary transferring roller 9Y is present between sheets after the primary transferring operation, it is time for the measurement timing of the resistance value measuring part 14. Here, the zero voltage or the weak voltage (+50 V) is applied from the yellow voltage applying part 12Y to the yellow primary transferring roller 9Y and the transfer voltages (+1,000 V) are applied from the respective voltage applying parts 12C, 12M and 12K to other primary transferring rollers 9C, 9M and 9K. At this time, by the current detecting part 13, the first total current value of the four primary transferring rollers 9 is detected. Subsequently, by the resistance value measuring part 14, the subject resistance value of the yellow primary transferring roller 9Y is measured on the basis of the current difference between the first total current value and the second total current value.

Further, by the transfer voltage correcting part 15, the subject resistance value of the yellow primary transferring roller 9Y and the predetermined target resistance value are compared with each other (step S3). In a case where a difference between these resistance values is less than the predetermined resistance value difference (step S3: NO), the correction execution trigger for the yellow primary transferring roller 9Y is set to OFF, or alternatively, in a case where the difference between these resistance values is equal to or more than the predetermined resistance value difference (step S3: YES), the correction execution trigger for the yellow primary transferring roller 9Y is set to ON (step S4).

Next, at a cyan image forming part 4C, image forming operation is carried out. At this time, the transfer voltage (+1,000 V) is applied from a cyan voltage applying part 12C to the cyan primary transferring roller 9C (the cyan primary transferring part 8C), and then, primary transferring operation of a cyan toner image is carried out with respect to a predetermined printing position on the intermediate transferring belt 3. The second total current value used to measure the resistance value of the cyan primary transferring roller 9C may be detected here.

When the cyan primary transferring roller 9C is present between sheets after the primary transferring operation, it is time for the measurement timing of the resistance value measuring part 14. Here, the zero voltage or the weak current (+50 V) is applied from the cyan voltage applying part 12C to the cyan primary transferring roller 9C and the transfer voltages (+1,000 V) are applied from the respective voltage applying parts 12Y, 12M and 12K to other primary transferrin rollers 9Y, 9M and 9K. At this time, by the current detecting part 13, the first total current value of the four primary transferring rollers 9 is detected. Subsequently, by the resistance value measuring part 14, the subject resistance value of the cyan primary transferring roller 9C is measured on the basis the current value between the first total current value and the second total current value.

Further, by the transfer voltage correcting part 15, the subject resistance value of the cyan primary transferring roller 9C and the predetermined target resistance value are compared with each other (step S5). In a case where a difference between these resistance values is less than the predetermined resistance value difference (step S5: NO), the correction execution trigger for the cyan primary transferring roller 9C is set to OFF, or alternatively, in a case where the difference between these resistance values is equal to or more than the predetermined resistance value difference (step S5: YES), the correction execution trigger for the cyan primary transferring roller 9C is set to ON (step S6).

With respect to the following magenta image forming part 4M and the following black image forming part 4M as well, the similar process to the yellow image forming part 4Y and the cyan image forming part 4C as described above is carried out (step S7 to S10), and then, the correction execution trigger for the magenta primary transferring roller 9M and the correction execution trigger for the black primary transferring roller 9K is set.

Next, the transfer voltage correcting part 15 executes transfer voltage correction with respect to the primary transferring roller 9 corresponding to the correction execution trigger of ON (step S11) and corrects the transfer voltage applied from the voltage applying part 12 to the primary transferring roller 9 to make the voltage value so that the predetermined target transferring current flows.

Although, in the above-described embodiment, an example of executing transfer voltage correction with respect to the primary transferring roller 9 corresponding to the correction execution trigger of ON after the correction execution triggers are set with respect to the four primary transferring roller 9 was described, the present disclosure is not limited by this example. For example, the transfer voltage correcting part 15 may decide the correction condition with respect to each primary transferring roller 9 and, if there is a need to correct the transfer voltage, continuously execute transfer voltage correction without setting the correction execution trigger.

According to the embodiment, as described above, the color printer 1 (the image forming apparatus) includes the annular intermediate transferring belt 3 (a transferring belt) rotating in the predetermined direction, the plurality of photosensitive drums 7, the plurality of primary transferring parts 8 (the plurality of primary transferring rollers 9), the plurality of voltage applying parts 12, the current detecting part 13 and the resistance value measuring part 14. The plurality of photosensitive drums 7 are disposed along the rotation direction of the intermediate transferring belt 3. The plurality of primary transferring parts 8 respectively transfer the images formed on the plurality of photosensitive drums 7 to the intermediate transferring belt 3. The voltage applying parts 12 apply the voltages to the plurality of respective primary transferring parts 8. The current detecting part 13 detects the total current value of the currents flowing through the plurality of primary transferring parts 8. The resistance value measuring part 14 measures the subject resistance value of each primary transferring part 8. When primary transferring operation is carried out at each primary transferring part 8, the corresponding voltage applying part 12 applies the transfer voltage to each primary transferring part 8. On the other hand, when resistance value measurement by the resistance value measuring part 14 is carried out, in a case where one primary transferring part 8 of the plurality of primary transferring parts 8 (the primary transferring part 8 as the measurement subject) is the measurement subject of the resistance value measuring part 14, the corresponding voltage applying part 12 applies the zero voltage or the weak voltage with the same polarity as the transfer voltage to the primary transferring part 8 as the measurement subject and applies the transfer voltage to other primary transferring parts 8 at the measurement timing when the primary transferring part 8 as the measurement subject is present between sheets. The current detecting part 13 detects the first total current value at the measurement timing as described above. The resistance value measuring part 14 measures the subject resistance value of the primary transferring part 8 as the measurement subject on the basis of the first total current value detected at the measurement timing as described above.

In addition, according to the embodiment, the resistance value measuring part 14, on the basis of the current value between the first total current value and the second total current value detected by the current detecting part 13 in a case where the transfer voltage is applied to all of the plurality of primary transferring parts 8, measures the subject current value flowing through the primary transferring part 8 as the measurement subject in a case where the transfer voltage is applied, and then, measures the subject resistance value on the basis of the transfer voltage and the subject current value.

In accordance with such a configuration, since it is possible to measure the resistance value in a state that the zero voltage or the weak voltage is applied to the primary transferring part 8 as the measurement subject, it is possible to utilize the measurement timing when the primary transferring part 8 as the measurement subject is present in a small space between sheets. In this manner, there is no need to provide exclusive time used for resistance value measurement of the primary transferring part 8, it is possible to reduce the time required for resistance value measurement, and moreover, it is possible to appropriately maintain productivity of image forming process using the plurality of primary transferring parts 8 without any degradation.

Further, according to the embodiment, the voltage applying parts 12, the current detecting part 13 and the resistance value measuring part 14 set, as the measurement timing, the timing immediately after transfer of the primary transferring part 8 as the measurement subject, and switches the measurement subject to the primary transferring part 8 immediately after transfer, every time the plurality of primary transferring parts 8 sequentially transfers images to the intermediate transferring belt 3 in accordance with the order of disposition.

In this manner, it is possible to set the measurement timing to an interval between a series of primary transferring operations by the plurality of primary transferring parts 8, that is, between a series of image forming processes by the plurality of image forming parts 4, and further, it is possible to appropriately maintain productivity of continuous printing without any degradation.

Moreover, according to the embodiment, the color printer 1 further includes the transfer voltage correcting part 15. The transfer voltage correcting part 15, when resistance value measurement by a resistance value measuring part 14 is carried out, in a case where the difference between a subject resistance value and the predetermined target resistance value is equal to or more than the predetermined resistance value, corrects the transfer voltage applied to the primary transferring part 8 as the measurement subject by the corresponding voltage applying part 12 to make the voltage value so that the predetermined target transfer voltage flows through the primary transferring part 8 as the measurement subject.

In this manner, since the resistance value measured as described above is utilized, it is possible to reduce the time required for transfer voltage correction, and moreover, it is possible to appropriately correct the transfer voltage applied to the primary transferring part 8 without degrading the productivity of image forming process. In addition, it is possible to prevent lowering of processing speed while avoiding unnecessary correction of transfer voltage.

Furthermore, according to the embodiment, the resistance value 14 sets, as the predetermined target resistance value, the subject resistance value measured by the resistance value measuring part 14 at the time of the preceding correction by the transfer voltage correcting part 15.

In this manner, it is possible to prevent lowering of the processing speed while avoiding unnecessary correction of transfer voltage more reliably.

In addition, according to the embodiment, the color printer 1 further includes the measurement condition deciding part 17 deciding whether or not resistance value measurement by the resistance value measuring part 14 should be carried out.

In this manner, it is possible to prevent lowering of the processing speed while avoiding unnecessary measurement of resistance value.

Moreover, according to the embodiment, the color printer 1 further includes the temperature sensing part 16. The temperature sensing part 16 senses the temperature in the vicinity of the intermediate transferring belt 3 and the plurality of primary transferring parts 8. The measurement condition deciding part 17 decides that resistance value measurement by the resistance value measuring part 15 should be carried out, in a case where the difference between the present temperature sensed by the temperature sensing part 16 and the preceding temperature sensed by the temperature sensing part 16 at the time of the preceding correction by the transfer voltage correcting part 15 is equal to or more than the predetermined temperature difference.

In this manner, since the temperature change which may cause any degradation of the primary transferring part 8 (the primary transferring roller 9) is decided by the measurement condition deciding part 17, it is possible to detect a change of resistance value more reliably.

Further, according to the embodiment, the measurement condition deciding part 17 decides that resistance value measurement by the resistance value measuring part 14 should be carried out, in a case where the driving time of the intermediate transferring belt 3 and the plurality of primary transferring parts 8 has elapsed by the predetermined time or more from the preceding correction by the transfer voltage correcting part 15.

In this manner, aged deterioration change which may cause any degradation of the primary transferring part 8 (the primary transferring roller 9) is decided by the measurement condition deciding part 17, it is possible to detect a change of resistance value more reliably.

Although the embodiments was described about a case applying the configuration of the present disclosure to the color printer 1, in another different embodiment, the configuration of the present disclosure may be applied to another image forming apparatus including the plurality of photosensitive drums, such as a copying machine, a facsimile and a multifunction peripheral.

Further, the above-description of the embodiments was described about one example of the image forming apparatus according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. An image forming apparatus comprising:

an annular transferring belt rotating in a predetermined direction;

a plurality of photosensitive drums disposed along a rotation direction of the transferring belt;

a plurality of primary transferring parts transferring images formed on the plurality of photosensitive drums to the transferring belt;

a plurality of voltage applying parts applying voltages to the respective primary transferring parts;

a current detecting part detecting a total current value of currents flowing thorough the plurality of primary transferring parts; and a resistance value measuring part measuring a subject resistance value of each of the primary transferring parts, wherein when transfer is carried out by each primary transferring part, the corresponding voltage applying part applies a transfer voltage to each primary transferring part, and, on the other hand, when resistance value measurement by the resistance value measuring part is carried out, in a case where one primary transferring part of the plurality of primary transferring parts is a measurement subject of the resistance value measuring part, the corresponding voltage applying part applies a zero voltage or a weak voltage within a range of +50V with the same polarity as the transfer voltage to the one primary transferring part and applies the transfer voltage to other primary transferring parts at a measurement timing when the one primary transferring part is present between sheets, the current detecting part detects a first total current value at the measurement timing, and the resistance value measuring part measures the subject resistance value of the one primary transferring part on the basis of the first total current value detected at the measurement timing.

2. The image forming apparatus according to claim 1, wherein the resistance value measuring part measures a subject current value flowing through the one primary transferring part in a case where the transfer voltage is applied, on the basis of a current difference between the first total current value and a second total current value detected by the current detecting part in a case where the transfer voltage is applied to all of the plurality of primary transferring parts, and measures the subject resistance value on the basis of the transfer voltage and the subject current value.

3. The image forming apparatus according to claim 1, wherein the voltage applying parts, the current detecting part and the resistance value measuring parts set, as the measurement timing, a timing immediately after transfer of the one primary transferring part, and switches the measurement subject to the primary transferring part immediately after transfer, every time images are sequentially transferred to the transferring belt in accordance with an order of disposition.

4. The image forming apparatus according to claim 2, wherein at a timing during transfer of the one primary transferring part, the corresponding voltage applying part applies the transfer voltage to all of the plurality of primary transferring parts, and the current detecting part then detects the second total current value.

5. The image forming apparatus according to claim 1 further comprising:

a transfer voltage correcting part correcting the transfer voltage applied to the one primary transferring part by the corresponding voltage applying part to a voltage value so that a predetermined target transfer current flows through the one primary transferring part, when resistance value measurement by the resistance value measuring part is carried out, in a case where a difference between the subject resistance value and a predetermined target resistance value is equal to or more than a predetermined resistance value difference.

6. The image forming apparatus according to claim 5, wherein the transfer voltage correcting part sets a correction execution trigger as a correction condition for each of the plurality of primary transferring parts, and sets the correction execution trigger to OFF in a case where the difference between the subject resistance value and the predetermined target resistance value is less than the predetermined resistance value difference, and, on the other hand, sets the correction execution trigger to ON, in a case where the difference between the subject resistance value and the predetermined target resistance value is equal to or more than the predetermined resistance value.

7. The image forming apparatus according to claim 5, wherein the resistance value measuring part sets, as the predetermined target resistance value, the subject resistance value measured by the resistance value measuring part at a time of preceding correction by the transfer voltage correcting part.

8. The image forming apparatus according to claim 5 further comprising:

a measurement condition deciding part deciding whether or not resistance value measurement by the resistance value measuring part should be carried out.

9. The image forming apparatus according to claim 8 further comprising:

a temperature sensing part sensing temperature in the vicinity of the transferring belt and the plurality of primary transferring parts, wherein the measurement condition deciding part decides that resistance value measurement by the resistance value deciding part should be carried out, in a case where a difference between the present temperature sensed by the temperature sensing part and the preceding temperature sensed by the temperature sensing part at a time of preceding correction by the transfer voltage correcting part is equal to or more than a predetermined temperature difference.

10. The image forming apparatus according to claim 8, wherein the measurement condition deciding part decides that resistance value measurement by the resistance value measuring part should be carried out, in a case where a driving time of the transferring belt and the plurality of primary transferring parts has elapsed by a predetermined time or more from previous correction by the transfer voltage correcting part.

* * * * *